US005273512A

United States Patent [19]

Ducasse

[11] Patent Number: 5,273,512

[45] Date of Patent: Dec. 28, 1993

[54] MILL FEEDER ROLL

[76] Inventor: Joseph C. V. Ducasse, 391 Donegal Pl., Martinez, Calif. 94553

[21] Appl. No.: 927,093

[22] Filed: Aug. 7, 1992

[51] Int. Cl.[5] ..... B21B 27/02

[52] U.S. Cl. ..... 492/36; 492/38; 492/45; 100/121; 100/176; 241/294

[58] Field of Search ..... 492/36, 38, 45; 100/121, 155 R, 176; 241/294, 227-234

[56] References Cited

U.S. PATENT DOCUMENTS

| | | | |
|---|---|---|---|
| 35,896 | 7/1862 | Rust | 100/121 X |
| 1,908,519 | 5/1933 | Leonard | 100/121 X |
| 1,996,394 | 4/1935 | Wodehouse | 492/36 X |
| 2,494,195 | 1/1950 | Penton | 100/121 X |
| 3,969,802 | 7/1976 | Bouvet | 100/121 X |
| 4,378,253 | 3/1983 | Bouvet | 100/121 X |
| 4,391,026 | 7/1983 | Casey et al. | 100/121 X |
| 4,447,941 | 5/1984 | Schnell et al. | 100/121 X |
| 4,561,156 | 12/1985 | Sun | 100/121 X |
| 4,765,550 | 8/1988 | Chen | 100/121 X |

FOREIGN PATENT DOCUMENTS

| | | | |
|---|---|---|---|
| 0108687 | 5/1984 | European Pat. Off. | 100/121 |
| 0242773 | 12/1969 | U.S.S.R. | 100/121 |
| 0171206 | 11/1921 | United Kingdom | 100/121 |
| 2134215 | 8/1984 | United Kingdom | 100/121 |

*Primary Examiner*—Timothy V. Eley
*Attorney, Agent, or Firm*—Fulbright & Jaworski

[57] ABSTRACT

An improved mill feeder roll to be used in combination with another roll for froce-feeding a mill of the type generally employed for grinding a material such as sugar cane and the like while contributing in pre-extracting and draining juice therefrom includes a fabricated hollow shell body mounted on a shaft with a drainage system in the form of a plurality of manifolds provided within the shell body and through which is drained a portion of the pre-extracted juice thereby leaving a drier material to be force-fed into the mill by the rotating action of the rolls.

7 Claims, 5 Drawing Sheets

MILL FEEDER ROLL

BACKGROUND OF THE INVENTION

The present invention relates to an improved mill feeder roll to be used in combination with another roll for force-feeding a mill of the type generally employed for grinding a material, such as sugar cane and the like, while contributing in pre-extracting and draining juice therefrom, thereby leaving a drier material to be force-fed into the mill by the rotating action of the rolls.

As is known in the sugar industry, the purpose of a cane mill is to grind sugar cane while extracting and recovering a maximum of juice therefrom. A conventional cane mill comprises basically a top roll and a bottom roll, the two rolls rotating in directions such that a blanket of sugar cane being nipped therethrough is ground. Sucrose extraction is achieved in conventional cane mills by providing "messchaert" grooves in the bottom rolls such that, as the blanket is nipped and ground between the two rolls, the sucrose juice is drained downwardly through the messchaert grooves. The mill top roll is mounted on a shaft supported in split bearings, the top half of each of which is subjected to hydraulic pressures acting downwardly thereon. The top roll can thus move up and down, depending on the thickness of the blanket of cane being nipped. An inherent disadvantage of such conventional cane mills, however, is the fact that a substantial amount of the extracted juice invariably becomes trapped in the upper part of the cane blanket, thereby causing reabsorption during passage of the incoming cane blanket between the rolls. Such reabsorption is quite undesirable, because it not only impairs the overall extraction of the mill but also its "feedability", and thus its capacity, through slippage of the roll surfaces against the wet cane. With a view of improving mill feedability, mill feeder rolls are now being used on most cane mills. The purpose of a mill feeder roll is to work in combination with another roll, generally the mill top roll, such that a blanket of cane being fed to the mill is first nipped between the two rolls, thereby causing pre-extraction of part of the juice contained in the cane, prior to the blanket of cane being force-fed into the mill by the rotating action of the rolls. Yet, because conventional mill feeder rolls do not have provision for draining the pre-extracted juice, their use, although improving somewhat the feedability of the mill, does not solve the problem of juice reabsorption by the incoming blanket of cane. In fact, because of the additional amount of juice extracted by this method, more juice becomes trapped in the upper part of the cane blanket.

To alleviate this disadvantage, a mill top roll having an internal drainage system has been devised which substantially improves the performance of a mill, by draining most of the juice which would otherwise become trapped in the upper part of the cane blanket. Such a roll is disclosed in U.S. Pat. No. 4,391,026. However, this type of roll is quite expensive to manufacture, due to its sophisticated design and the fact that it has to be necessarily of very heavy construction in order to be able to lift against the considerable pressures (usually 65 to 70 tonnes per foot of roll length) to which its bearings are subjected during operation.

In the light of what has been dicussed above, it becomes apparent that the ideal solution for overcoming the above noted disadvantages would be to provide an improved mill feeder roll of relatively light and inexpensive construction, which would have the additional capability of draining part of the pre-extracted juice, while contributing in force-feeding the mill with a drier blanket of cane.

SUMMARY OF THE INVENTION

With the above discussion in mind, it is a primary object of the present invention to provide an improved mill feeder roll to be used in combination with another roll for force-feeding a mill of the type generally employed for grinding a material, such as sugar cane and the like, while contributing in pre-extracting and draining a portion of the juice therefrom, thereby leaving a drier material to be force-fed into the mill by the rotating action of the rolls.

A further object of the present invention is to provide such an improved mill feeder roll of relatively light and inexpensive construction that would still accomplish a similar function as does the device disclosed in U.S. Pat. No. 4,391,026.

The above objects are achieved in accordance with the present invention by the provision of an improved mill feeder roll to be used in combination with another roll for force-feeding a mill of the type generally employed for grinding a material such as sugar cane and the like while contributing in pre-extracting and draining a portion of the juice therefrom thereby leaving a drier material to be force-fed into the mill by the rotating action of the rolls, such mill feeder roll comprising a hollow shell body mounted on a shaft. The shell body, according to the present invention, includes, substantially concentrically disposed about its axis, two parallel lateral flanges whose outer peripheries correspond to the outer periphery of the shell body, a circular central pipe connecting the flanges, a plurality of straight flat ribs radially disposed and extending outwardly along the outer periphery of the central pipe with their ends secured to the flanges, a plurality of straight flat plates extending between each adjacent pair of ribs with their ends secured to the flanges, a drainage system in the form of a plurality of manifolds each of which includes an open-ended outlet pipe located underneath each plate and extending between each adjacent pair of ribs with its ends secured through the flanges and a series of intermediate pipes connecting the outlet pipe to a series of openings located at the top of each plate, and two hubs mounted one each on the flanges with the shaft extending therethrough.

The ribs are disposed so that their upper edges lie substantially along a common periphery. The plates are arranged between each adjacent pair of ribs so as to improve the gripping action of the shell body on the material being ground. For example, the plates may be so arranged as to allow their adjacent edges to form a series of longitudinal grooves in combination with the upper edges of the ribs, by connecting their lower longitudinal corners to the adjacent upper corners of each pair of ribs, with the upper corners of the plates lying along the outer periphery of the shell body. Alternatively, the ribs may have their upper edges disposed along the outer periphery of the shell body, with the plates connecting them at a short distance below. In the first case, the grooves become filled with particles of the material being ground and, as such, serve the purpose of improving the gripping action of the shell body on the material. Whereas, in the second case, it is the protruding upper edges of the ribs that serve such purpose. To prevent clogging of the openings during operation, each is made substantially rectangular at the top, with its longer dimension extending substantially circumferentially of the shell body and its cross-sectional area increasing in a direction substantially radially inwardly thereof. The openings are preferably formed into separate pieces of a non-corrosive metal that can either be inserted or simply secured on top of the plates, so as to be replaceable.

Most of the structure of each manifold lies bare within the space contained between each adjacent pair of ribs and underneath each plate. The intermediate pipes as well as the outlet pipes are preferably made of light gauge stainless steel. The entire shell body is so constructed that the external forces exerted on it during operation do not in any way affect the structure of the manifolds. During operation, the pre-extracted juice is drained through the openings and intermediate pipes into and out of the outlet pipes of the manifolds, under the nipping action of the rolls on the cane. So-called juice rings may be installed at each end of the shell body for preventing splashing of the juice flowing out of the outlet pipes.

The hubs may be provided with keys for the purpose of keying the shell body on the shaft, in which case the shaft is supported in bearings and rotates along with the shell body during operation. Alternatively, the hubs may be provided with grease or oil lubricated bushings, in which case the shaft is held fixed while only the shell body rotates during operation.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
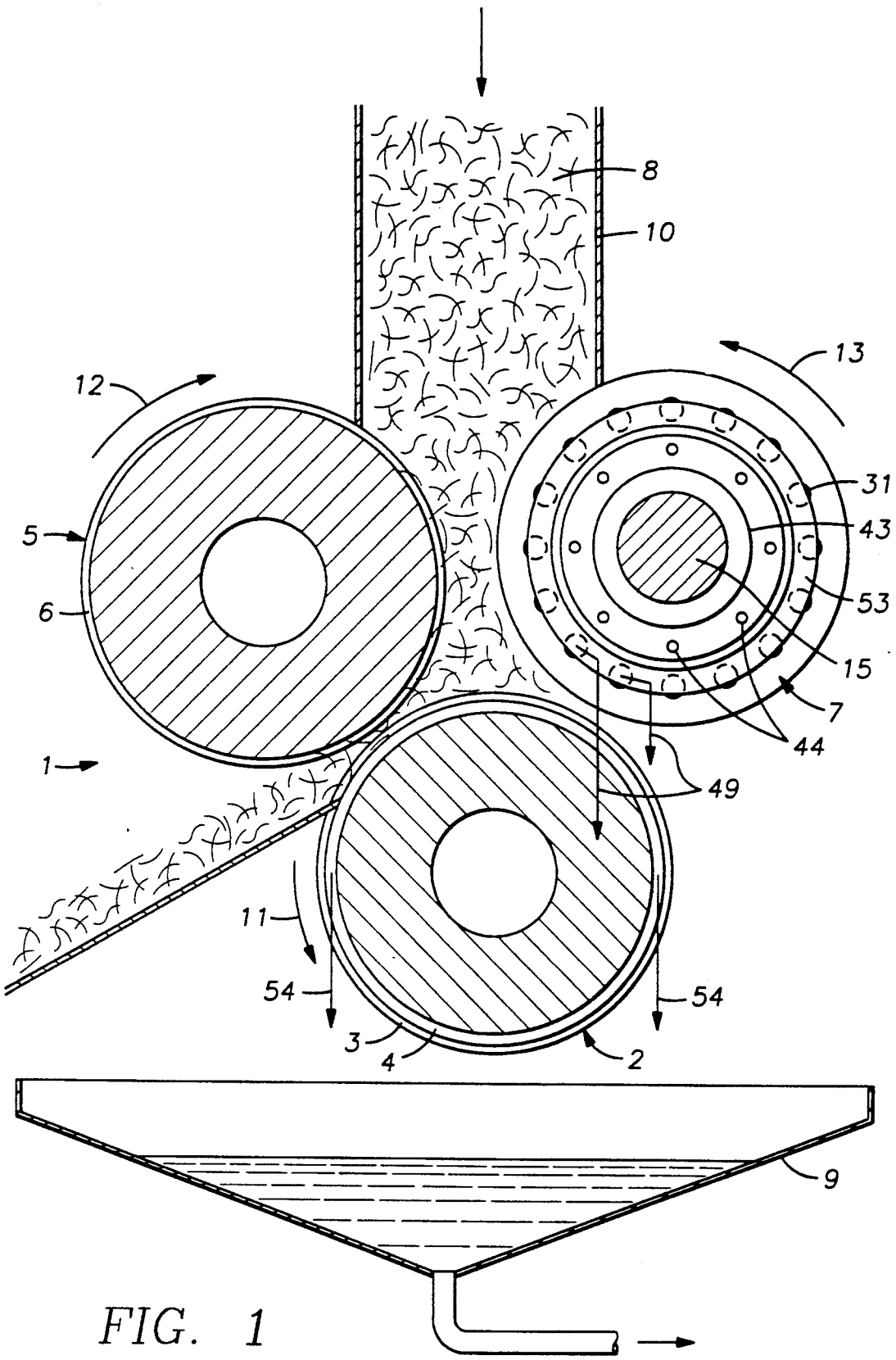
FIG. 1 is a somewhat schematic cross-sectional view through a conventional cane mill employing a mill feeder roll of the present invention.
Figure 2:
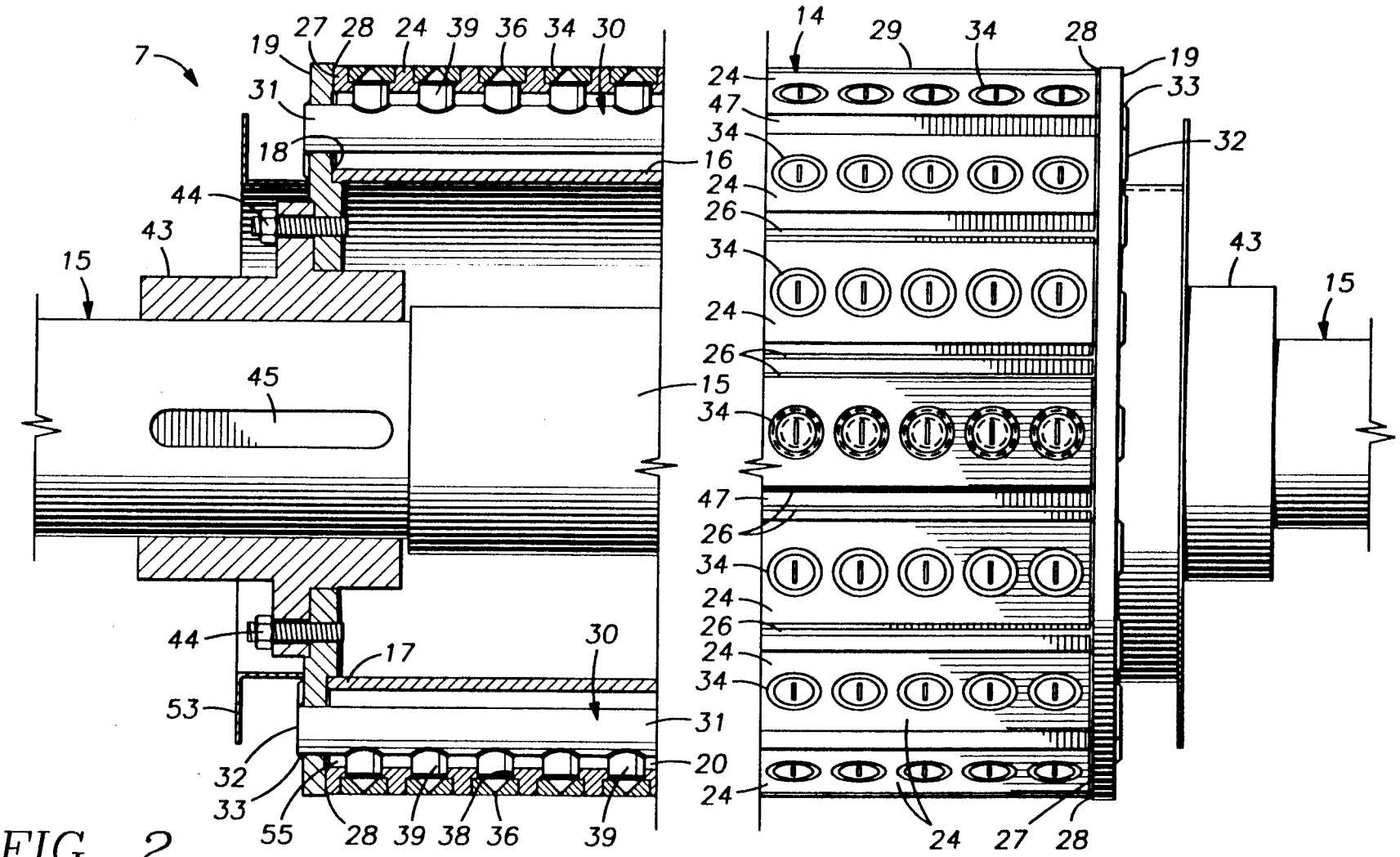
FIG. 2 is an elevation view showing, partially in section, a preferred embodiment of the feeder roll of the present invention.
Figure 3:
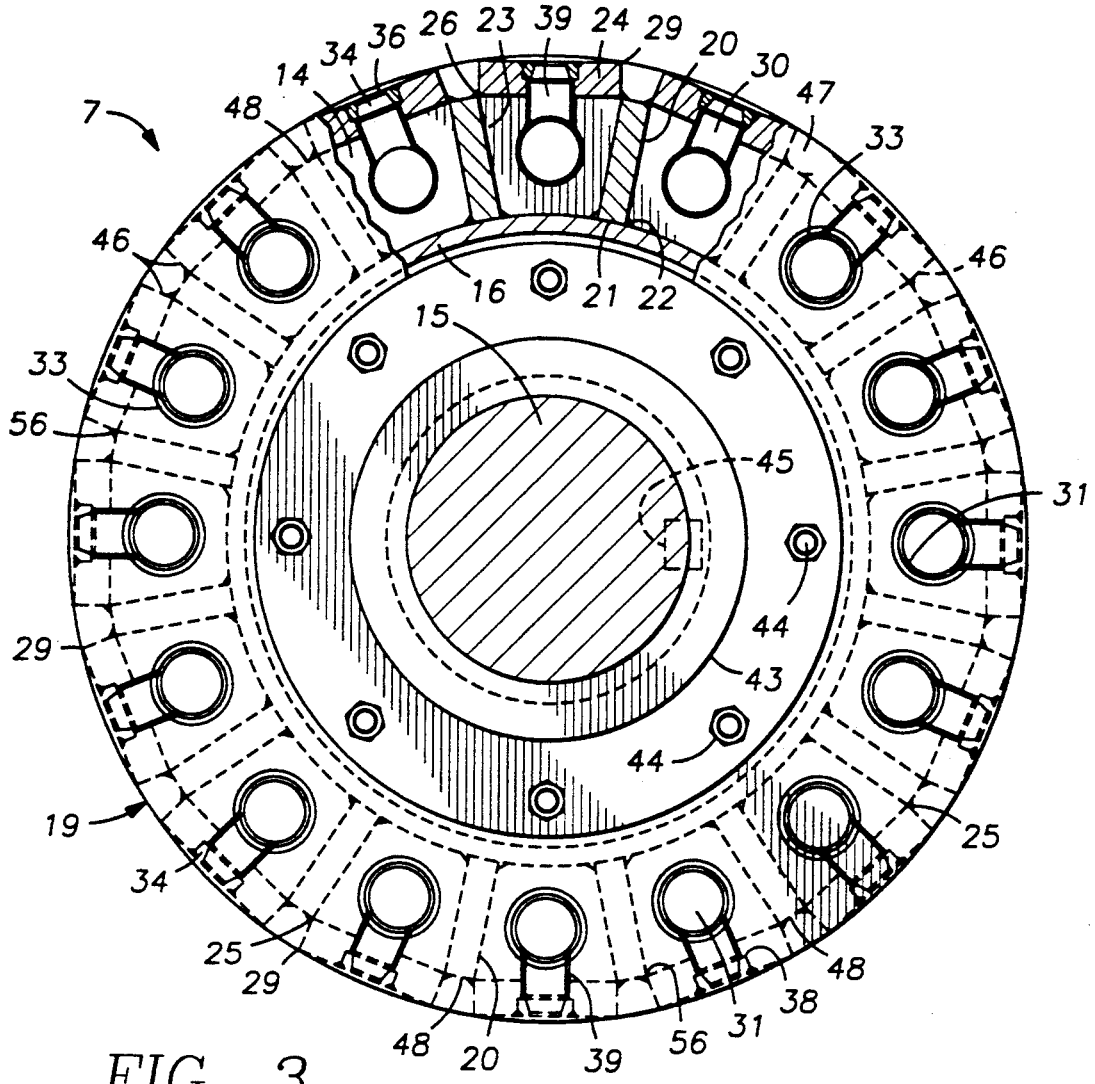
FIG. 3 is a side view, partially broken away, of the roll shown in FIG. 2.
Figure 5:
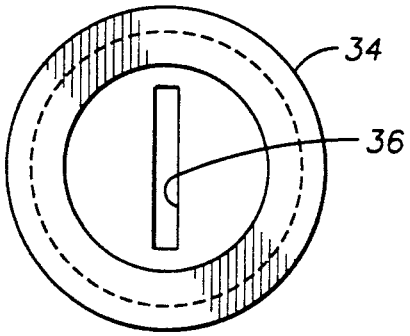
FIG. 5 is a plan view of an insert fitted with an opening as employed in the embodiment of FIG. 2.

With reference to FIG. 1 of the drawings, a conventional mill 1 is shown including a known bottom roll 2 having formed in the periphery thereof a plurality of grooves 3, for example substantially V-shaped grooves, from the bottom of which extend messchaert grooves 4. The cane mill 1 further includes a known top roll 5 having formed in the periphery thereof a plurality of grooves 6 corresponding to and disposed to intermesh with grooves 3; a feeding hopper 10; and a mill juice tray 9. Mounted above roll 2 and ahead of roll 5 is a mill feeder roll 7 of the present invention, with its outer periphery lying at a relatively close distance from that of roll 5. Also shown, is a blanket of sugar cane 8 being continuously fed to mill 1 via hopper 10 and the space included between the peripheries of rolls 5 and 7, with rolls 2, 5, and 7 rotating in directions as shown by arrows 11, 12, and 13 respectively.

With more particular reference to FIGS. 1 thru 6 of the drawings, the mill feeder roll 7 comprises a hollow shell body 14 mounted on a shaft 15, shell body 14 including, substantially concentrically disposed about its axis, two parallel lateral flanges 19 whose outer peripheries correspond to the outer periphery of shell body 14; a circular central pipe 16 having its ends 17 connected to flanges 19 by means of welds 18; a plurality of straight flat ribs 20 radially disposed and extending outwardly along the outer periphery of pipe 16 with their bottom edges 21 secured thereon by means of welds 22 and their ends 55 to flanges 19 by means of welds 23; a plurality of straight flat plates 24 each provided with a series of holes 38 and extending between each adjacent pair of ribs 20 with their longitudinal lower corners 25 welded to the adjacent upper corners 56 of ribs 20 by means of welds 26, their ends 27 secured to flanges 19 by means of welds 28 and their longitudinal upper corners 29 lying along the periphery of shell body 14; a drainage system comprising a plurality of manifolds 30 each of which includes an open-ended circular outlet pipe 31 disposed longitudinally between each pair of ribs 20 and underneath each plate 24 with its ends 32 secured through flanges 19 by means of welds 33 and a series of circular intermediate pipes 39 connecting outlet pipe 31 through holes 38 to a series of openings 36 located at the top of each plate 24; and two hubs 43 mounted one on each flange 19 by means of fasteners 44 with shaft 15 extending through hubs 43 as shown.

Figure 7:
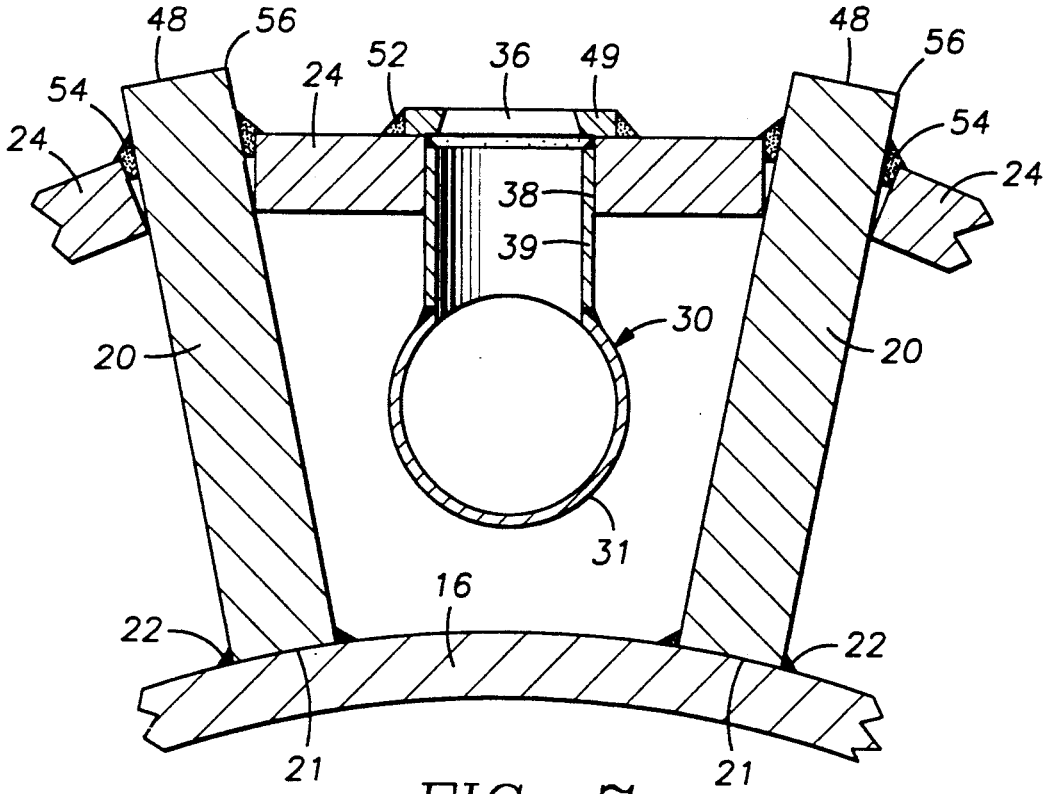
FIG. 7 is a view similar to FIG. 6 but of a modified embodiment of the present invention.

Ribs 20 are so disposed that their upper edges 48 lies substantially along a common periphery. Plates 24 are arranged between each adjacent pair of ribs 20 so as to form grooves or ridges at the outer periphery of shell body 14 with a view of increasing its gripping action on blanket 8 during operation. For example, as particularly shown in FIG. 6, plates 24 may be arranged so that their adjacent edges 46 form a series of longitudinal grooves 47 in combination with the upper edges 48 of ribs 20. Alternatively, ribs 20 may have their upper corners 56 lying along the outer periphery of shell body 14, with plates 24 secured to them at a short distance below their edges 48 by means of welds 54, as shown in FIG. 7. In the first case, grooves 47 become filled with cane particles during operation and, as such, serve the purpose of increasing the gripping action of shell body 14 on blanket 8. Whereas, in the second case, it is the protruding portions of the upper edges 48 of ribs 20 that serve such purpose.

Figure 8:
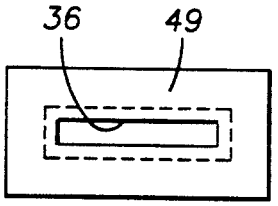
FIG. 8 is a plan view of a flat piece of metal fitted with an opening as employed in the embodiment of FIG. 7.
Figure 4:
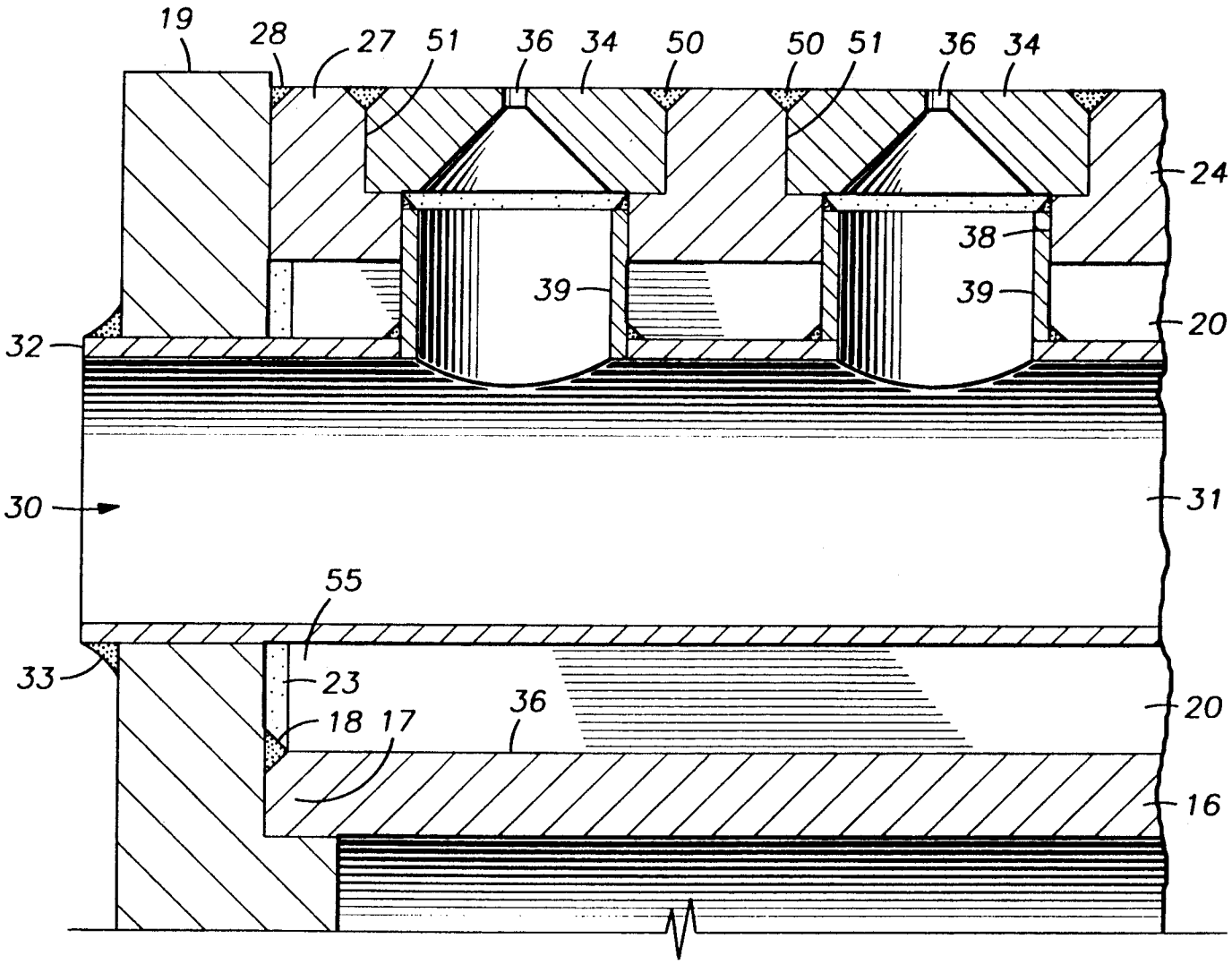
FIG. 4 is an enlarged cross-sectional view of a portion of FIG. 2.
Figure 6:
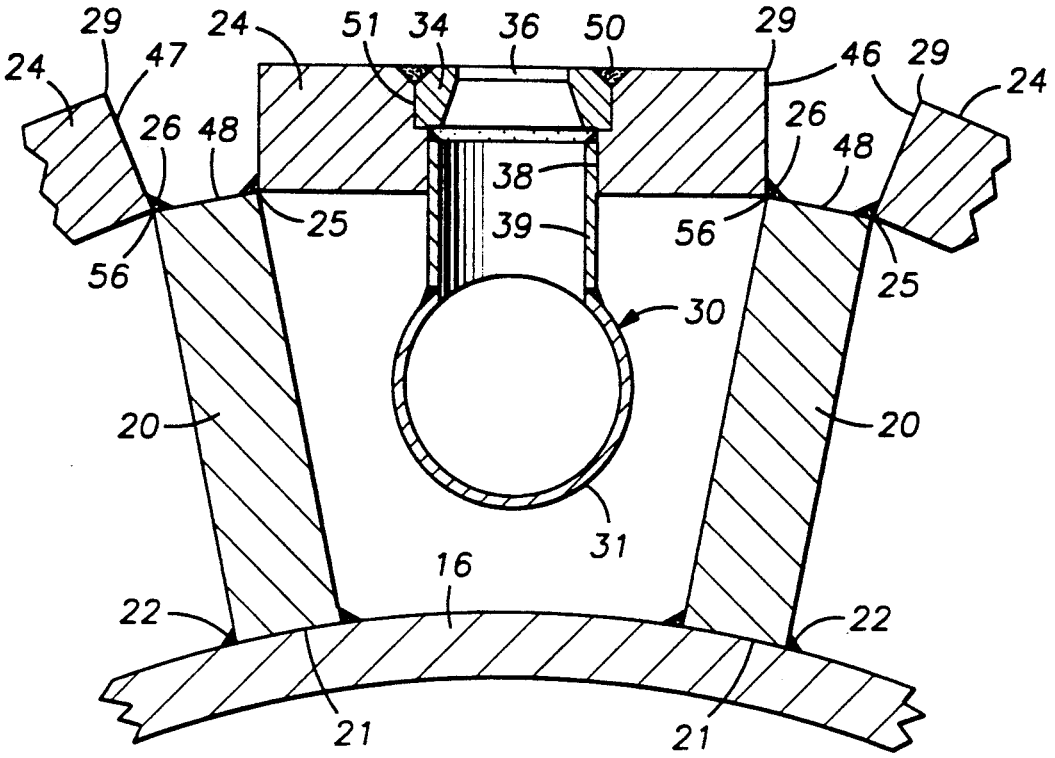
FIG. 6 is an enlarged cross-sectional view of a portion of FIG. 3.

To prevent clogging of openings 36 during operation, each is made substantially rectangular at the top, with its longer dimension extending substantially circumferentially of shell body 14 and its cross-sectional area increasing in a direction substantially radially inwardly of shell body 14. Each opening 36 is preferably formed into a separate piece of non-corrosive metal having either a circular exterior configuration such as that of insert 34 shown in FIG. 5 or, for example, a rectangular exterior configuration such as that of the flat piece of metal 49 shown in FIG. 8. This way, when opening 36 is worn-out, it can be replaced by simply replacing the piece of metal to which it belongs.

In the embodiment illustrated in FIGS.1 thru 6, inserts 34 are secured by means of welds 50 into recesses 51 provided on top of holes 38, with their upper surfaces lying flush with the outer surfaces of plates 24. Whereas, in the embodiment illustrated in FIGS. 7 and 8, the flat pieces of metal 49 are simply welded on top of holes 38 to the outer surfaces of plates 24 by means of welds 52.

Shaft 15 may be provided with keys 45 for the purposes of keying hubs 43 thereon, in which case shaft 15 is supported in bearings (not shown) and rotates along with shell body 14 during operation. Alternatively, hubs 43 may be provided with grease or oil lubricated bushings (not shown), in which case shaft 15 is held fixed while only shell body 14 rotates during operation. So-called juice rings 53 may be installed at each end of shell body 14 for preventing splashing of the juice flowing out of pipes 31, as shown.

Returning now to FIG. 1 of the drawings, and supposing that roll 7 has been removed and that the blanket of sugar cane 8 is being fed directly into mill 1. This would result in blanket 8 being nipped and ground between rolls 2 and 5 while a portion of the juice contained in the cane would be extracted and drained in the conventional manner via messchaert grooves 4, as indicated by arrows 54. However the nipping action of rolls 2 and 5 being exerted on the cane would at the same time cause a substantial part of the juice being extracted to be forced backwardly into blanket 8. Since the density of blanket 8 is lower at its upper part, the juice being so forced backwardly would naturally find its way up blanket 8 to ultimately become trapped in the upper part thereof.

Now, in supposing that a conventional mill feeder roll 7A (not shown) is mounted in place of roll 7, blanket 8 would be first nipped between rolls 5 and 7A, thereby causing pre-extraction of a portion of the juice contained in the cane while blanket 8 would be compressed downwardly and force-fed into mill 1 by the rotating action of the rolls. However, the nipping action of rolls 5 and 7A being exerted on the cane would at the same time cause a substantial part of the juice being pre-extracted to be forced upwardly into blanket 8. Since the density of blanket 8 is much lower at its upper part and because of the fact that roll 7A is not provided with a drainage system, the pre-extracted juice being so forced upwardly would become trapped in the upper part of blanket 8.

Now, by replacing roll 7A by roll 7, most of the pre-extracted juice would be readily drained through manifolds 30 of roll 7, by being forced through openings 36 and intermediate pipes 39 to flow into and out of pipes 31 on each side of shell body 14 into mill tray 9, as indicated by arrows 49, while the resulting drier lower part of blanket 8 would be compressed and force-fed into mill 1 by the rotating action of rolls 5 and 7. In supposing now that a mill top roll 5A (not shown) as described in U.S. Pat. No. 4,391,026 is mounted in place of roll 5 to work in combination with roll 7, much more of the pre-extracted juice would be drained into tray 9, because drainage would then be effected through both rolls 7 and 5A, thereby leaving a much drier blanket of cane to be forced-fed into mill 1.

It is to be noted that when roll 7 works in combination with roll 5,and blanket 8 is being nipped and compressed between them, the pre-extracted juice contained in the layer of cane closer to roll 5 cannot travel laterally through blanket 8 to be drained through roll 7, because of the high density of blanket 8. Similarly, when roll 5A works in combination with roll 7A, the pre-extracted juice contained in the layer of cane closer to roll 7A cannot travel laterally through blanket 8 to be drained through roll 5A.

Although the present invention has been described and illustrated with regard to preferred embodiments thereof, it is to be understood that various modifications may be made without departing from the scope of the present invention. Furthermore it is understood that other modifications which are conventional in the art may be made to the configuration of the mill feeder roll of the present invention, as long as the fundamental novel features of the present invention, as described therein, are not obviated.

What I claim is:

1. An improved mill feeder roll to be used in combination with another roll for force-feeding a mill of the type generally employed for grinding a material, such as sugar cane, while contributing to the pre-extracting and draining of juice therefrom, comprising:

a shaft having two ends;

a central pipe disposed about the shaft, the central pipe having two ends and an outer surface;

two parallel flanges mounted to the ends of the shaft and the central pipe;

a plurality of straight, flat ribs disposed longitudinally along the outer surface of the central pipe, the ribs extending radially relative to the central pipe and attached to the flanges;

a plurality of straight, flat plates, each plate disposed between each of the ribs defining a plurality of longitudinal passageways along the outer surface of the central pipe, each plate having a plurality of openings therethrough;

a plurality of outlet pipes disposed within the plurality of longitudinal passageways, each outlet pipe having two ends mounted through the flanges; and communication means between the outlet pipes and the plate openings.

2. The mill feeder roll of claim 1 in which the plates have longitudinal lower corners, the ribs have longitudinal upper corners, and the longitudinal lower corners of the plates are fixed to the longitudinal upper corners of the ribs, defining a series of longitudinal grooves.

3. The mill feeder roll of claim 1 in which the plates are disposed between the ribs so that the ribs extend further from the central pipe than do the plates, defining a series of longitudinal grooves.

4. The mill feeder roll of claim 1 in which the openings in the plates are substantially rectangular with the longer dimensions extending circumferentially relative to the central pipe, and in which the cross-sectional area of the openings increases proximal to the central pipe.

5. The mill feeder roll of claim 1 having removable metal inserts in the plates, the inserts defining the openings in the plates.

6. The mill feeder roll of claim 1 having juice rings mounted thereto.

7. The mill feeder roll of claim 1 in which the elements thereof are connected by welds.

* * * * *